US011027538B2

(12) United States Patent
Fujimaki

(10) Patent No.: US 11,027,538 B2
(45) Date of Patent: Jun. 8, 2021

(54) REGISTER ERROR DETECTION DEVICE, REGISTER ERROR DETECTION METHOD, AND PRINTED MATTER

(71) Applicant: TAIYO ELECTRIC INDUSTRY CO., LTD., Tokyo (JP)

(72) Inventor: Katsuhiko Fujimaki, Tokyo (JP)

(73) Assignee: Taiyo Electric Industry Co., Ltd., Tokyo (JP)

( * ) Notice: Subject to any disclaimer, the term of this patent is extended or adjusted under 35 U.S.C. 154(b) by 150 days.

(21) Appl. No.: 16/261,073

(22) Filed: Jan. 29, 2019

(65) Prior Publication Data

US 2019/0152215 A1 May 23, 2019

Related U.S. Application Data

(63) Continuation of application No. PCT/JP2016/073734, filed on Aug. 12, 2016.

(51) Int. Cl.

| | |
|---|---|
| ***B41F 13/12*** | (2006.01) |
| ***B41F 33/00*** | (2006.01) |
| ***B41F 13/02*** | (2006.01) |

(52) U.S. Cl.

CPC ..... *B41F 13/12* (2013.01); *B41F 13/025* (2013.01); *B41F 33/00* (2013.01); *B41F 33/0081* (2013.01)

(58) Field of Classification Search

CPC .... B41F 13/025; B41F 13/12; B41F 33/0081; B41P 2233/52

See application file for complete search history.

(56) References Cited

U.S. PATENT DOCUMENTS

| | | | | |
|---|---|---|---|---|
| 4,450,766 | A | 5/1984 | Inomata et al. | |
| 5,018,213 | A | 5/1991 | Sikes | |
| 6,072,587 | A * | 6/2000 | Hicks | B41J 11/46 358/1.18 |
| 6,129,015 | A | 10/2000 | Dewey | |
| 2003/0010235 | A1 * | 1/2003 | Siler | B41F 33/0081 101/180 |

(Continued)

FOREIGN PATENT DOCUMENTS

| | | | |
|---|---|---|---|
| CN | 1948009 | A | 4/2007 |
| CN | 101152782 | A | 4/2008 |

(Continued)

OTHER PUBLICATIONS

Office Action dated May 28, 2019 in JP Application No. 2018-533392.

(Continued)

*Primary Examiner* — Jennifer E Simmons

(74) *Attorney, Agent, or Firm* — Muncy, Geissler, Olds and Lowe, P.C.

(57) ABSTRACT

In a register error detection device, an image capturing unit captures an image of two first register marks of a first color printed on a substrate by a first plate cylinder of a rotary printing press and a second register mark of a second color printed on the substrate by a second plate cylinder of the rotary printing press. A calculation unit calculates a register error based on the number of pixels between a reference position located between the two first register marks and a comparison position that is based on the second register mark in the image captured by the image capturing unit.

10 Claims, 7 Drawing Sheets

(56) References Cited

U.S. PATENT DOCUMENTS

| | | | | |
|---|---|---|---|---|
| 2011/0297826 | A1* | 12/2011 | Madokoro | H01J 37/153<br>250/307 |
| 2013/0145946 | A1* | 6/2013 | Chiari | B41F 9/021<br>101/481 |

FOREIGN PATENT DOCUMENTS

| | | | |
|---|---|---|---|
| CN | 102674066 | A | 9/2012 |
| CN | 203681008 | U | 7/2014 |
| JP | H0315553 | A | 1/1991 |
| JP | H03184052 | A | 8/1991 |
| JP | H08174802 | A | 7/1996 |
| JP | H08267727 | A | 10/1996 |
| JP | H1148458 | A | 2/1999 |
| JP | 2007106042 | A | 4/2007 |
| JP | 2013537860 | A | 10/2013 |

OTHER PUBLICATIONS

Office Action of corresponding Chinese Patent Application No. 201680088085.0, dated Mar. 16, 2020, 9 pages.
Office Action of corresponding Korean patent application No. 10-2018-7033616, dated Jan. 30, 2020, 7 pages.
Office Action dated Dec. 19, 2019 in India Application No. 201917002829.

* cited by examiner

REGISTER ERROR DETECTION DEVICE, REGISTER ERROR DETECTION METHOD, AND PRINTED MATTER

CROSS-REFERENCE TO RELATED APPLICATIONS

This application is a Continuation of International Application No. PCT/JP2016/073734, filed on Aug. 12, 2016, the disclosures of which Application are incorporated by reference herein.

BACKGROUND

1. Field of the Disclosure

The present disclosure relates to a register error detection device and a register error detection method for detecting a register error based on a register mark and to a printed matter on which the register mark is printed.

2. Description of the Related Art

In the case of printing a multicolored picture on a web by a rotary printing press, printing is generally done by overlapping colors on a color-by-color basis so as to form a single picture. In this case, there is a case where misalignment occurs in the printing at the time of the overlapping of the colors, and it is therefore necessary to have correct alignment so as not to cause misregister. In order to achieve this purpose, an automatic control device called an automatic registering device is used. This automatic registering device generally includes a register error detection device for detecting register errors based on a register mark printed for each color on a web and controls a compensator roller or plate cylinder of a rotary printing press so as to correct misregister. Register marks are also referred to as register marks.

For example, the register error detection device includes two line sensors provided at a reference interval therebetween along the transporting direction of the web, and the amount of deviation of the interval of register marks of two colors, that is detected by the line sensors, from a reference interval is referred to as a register error e.g., see Japanese Patent Application Publication No. H08-267727).

After printing, the region of a web in which register marks are printed is cut out. Therefore, in order to save loss, register marks are preferably reduced in size. However, it is difficult to reduce the size of register marks without decreasing the accuracy of detecting register errors.

SUMMARY

In this background, a purpose of the present disclosure is to provide a technology capable of reducing the size of register marks while suppressing a decrease in the accuracy of detecting register errors.

A register error detection device according to one embodiment of the present invention includes: an image capturing unit that captures an image of two first register marks of a first color printed on a substrate by a first plate cylinder of a rotary printing press and a second register mark of a second color printed on the substrate by a second plate cylinder of the rotary printing press; and a calculation unit that compares a reference position located between the two first register marks with a comparison position that is based on the second register mark in the image captured by the image capturing unit.

Another aspect of one embodiment of the present invention is a register error detection method. This method includes: capturing an image of two first register marks of a first color printed on a substrate by a first plate cylinder of a rotary printing press and a second register mark of a second color printed on the substrate by a second plate cylinder of the rotary printing press; and comparing a reference position located between the two first register marks with a comparison position that is based on the second register mark in the image that has been captured.

Still another embodiment of the present invention is a printed matter. This printed matter is a printed matter is a printed matter on which a register mark for controlling over printing misalignment in a rotary printing press is printed, comprising: a substrate; two first register marks of a first color printed on the substrate by a first plate cylinder of the rotary printing press; and a second register mark of a second color printed on the substrate by a second plate cylinder of the rotary printing press.

Optional combinations of the aforementioned constituting elements and implementations of the disclosure in the form of methods, apparatuses, systems, recording mediums, and computer programs may also be practiced as additional modes of the present disclosure.

DETAILED DESCRIPTION

First Embodiment

Figure 1:
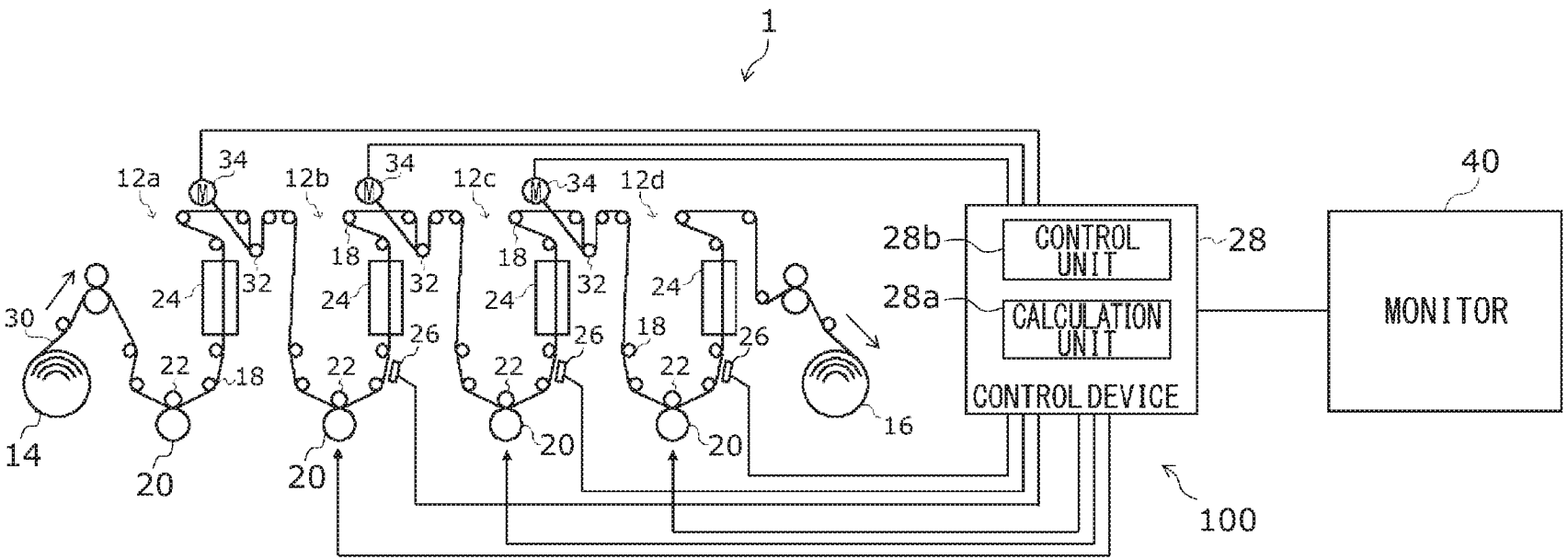
FIG. 1 is a diagram showing a rotary printing press including a register error detection device according to a first embodiment.

FIG. 1 is a diagram showing a rotary printing press 1 including a register error detection device 100 according to a first embodiment. The rotary printing press 1 shown in FIG. 1 is a multicolor gravure rotary printing press capable of printing four colors on a web 30 such as a film, which is a substrate (printing target material).

As shown in FIG. 1, the rotary printing press 1 includes a first printing unit 12*a*, a second printing unit 12*b*, a third printing unit 12*c*, a fourth printing unit 12*d*, an unwinding unit 14, a winding unit 16, a plurality of compensator rollers 32, a plurality of register motors 34, a monitor 40, and a register error detection device 100.

The four units: the first printing units 12*a*; the second printing unit 12*b*; the third printing unit 12*c*; and the fourth printing unit 12*d*, are arranged in series. The first printing unit 12*a*, the second printing unit 12*b*, the third printing unit 12*c*, and the fourth printing unit 12*d* are collectively referred to as "printing units 12" as appropriate.

The unwinding unit 14 for supplying the web 30 on which printing is to be done is installed upstream of the first printing unit 12*a*. Further, the winding unit 16 for winding the web 30 on which printing is done is installed downstream of the fourth printing unit 12*d*. Each printing unit 12 is provided with a plurality of guide rollers 18, to form a conveying path for the web 30.

To each printing unit 12, a cylindrical plate cylinder 20 for transferring ink, which serves as a coating agent, is installed on the lower side of the web 30 and a cylindrical impression cylinder 22 for applying pressure to the web 30 is installed on the upper side of the web 30 in such a manner that the cylindrical plate cylinder 20 and the cylindrical impression cylinder 22 are freely rotatable around their respective cylindrical axes, while sandwiching the web 30. A dryer 24 for drying the printing surface of the web 30 is disposed downstream of each plate cylinder 20.

The register error detection device 100 includes three image capturing units 26 and a control device 28. The control device 28 has a calculation unit 28*a* and a control unit 28*b*. Between the plate cylinder 20 and the dryer 24 in each of the second printing unit 12*b*, the third printing unit 12*c*, and the fourth printing unit 12*d*, the image capturing unit 26 is disposed. The image capturing units 26 are formed using, for example, a charged coupled device (CCD), a complementary metal oxide semiconductor (CMOS), or the like that receives light and converts the light into an electric signal.

For example, the image capturing unit 26 of the second printing unit 12*b* captures an image of a first register mark printed by the first printing unit 12*a* located upstream thereof and a second register mark printed by the plate cylinder 20 of the second printing unit 12*b*. The first register mark and the second register mark are marks for controlling printing misalignment in the rotary printing press 1. The image capturing unit 26 is electrically connected to the control device 28. The calculation unit 28*a* of the control device 28 calculates the register error between the first register mark and the second register mark based on an image captured by the image capturing unit 26. The calculation unit 28*a* is able to calculate a longitudinal register error that is misregister in the transporting direction of the web 30 and a lateral register error that is misregister in the direction orthogonal to the transporting direction within the plane of the web 30.

In the same way, the image capturing unit 26 of the third printing unit 12*c* and the image capturing unit 26 of the fourth printing unit 12*d* each captures an image of a first register mark printed by a printing unit 12 located upstream thereof and a second register mark printed by the plate cylinder 20 of the own printing unit. For each of the third printing unit 12*c* and the fourth printing unit 12*d*, the calculation unit 28*a* also calculates the register error between the first register mark and the second register mark based on an image captured by the image capturing unit 26. Details regarding the calculation of register errors will be described later.

Compensator rollers 32 for adjusting the supply phase of the web 30 are respectively arranged between the first printing unit 12*a* and the second printing unit 12*b*, between the second printing unit 12*b* and the third printing unit 12*c*, and between the third printing unit 12*c* and the fourth printing unit 12*d*. The compensator roller 32 is driven by the register motor 34. Each register motor 34 is electrically connected to the control device 28 and moves the compensator roller 32 up and down according to an instruction from the control unit 28*b* of the control device 28 so as to eliminate longitudinal register errors. Thereby, it is possible to correct printing misalignment in the longitudinal direction in each printing unit 12.

The respective plate cylinders 20 of the second printing unit 12*b*, the third printing unit 12*c*, and the fourth printing unit 12*d* move in the lateral direction so as to eliminate lateral direction register errors based on an instruction from the control unit 28*b* of the control device 28. Thereby, it is possible to correct printing misalignment in the lateral direction in each printing unit 12.

Further, the monitor 40 is connected to the control device 28 and displays an image captured by the image capturing unit 26 and the like. By monitoring the monitor 40, the user can visually recognize the condition of misregister.

The control device 28 includes a computer, and the various functions of the control device 28 are implemented in hardware by a circuit block, memory, or other LSI's and in software by a program loaded in memory, etc. Thus, a person skilled in the art should appreciate that the various functions of the control device 28 can be accomplished in various forms by hardware only, software only, or the combination of both, and the way of accomplishing these functions is not limited to any particular one.

Figure 2:
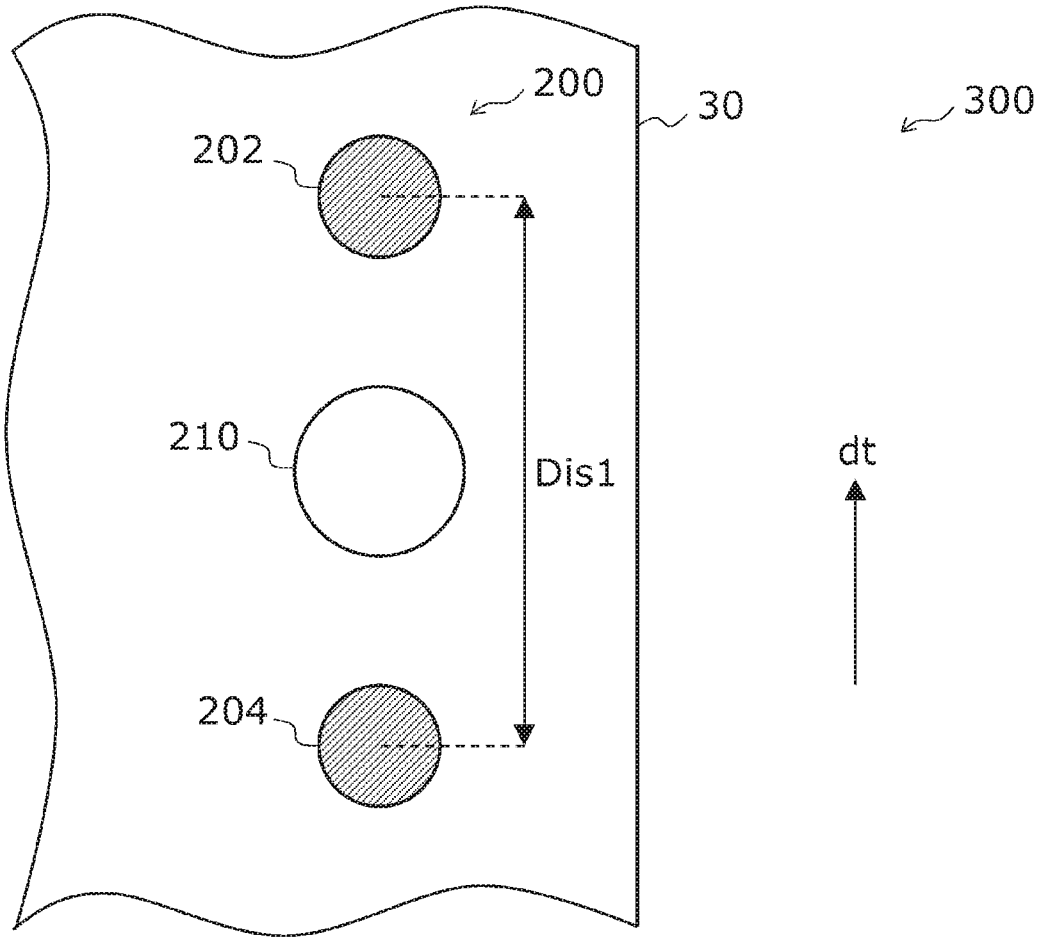
FIG. 2 is a diagram showing a part of a printed matter on which register marks according to the first embodiment are printed.

FIG. 2 is a diagram showing a part of a printed matter 300 on which a register mark 200 according to the first embodiment is printed. The printed matter 300 includes a web 30, two first register marks 202 and 204 of a first color, and a second register mark 210 of a second color different from the first color. The first register marks 202 and 204 and the second register mark 210 are collectively referred to as a register mark 200. Although not shown in the figure, a pattern of the first color and a pattern of the second color are printed in a region other than the region of the web 30 where the register mark 200 is printed.

The two first register marks 202 and 204 are printed on the web 30 by a plate cylinder (first plate cylinder) 20 of the first printing unit 12*a* of the rotary printing press 1. The second register mark 210 is printed on the web 30 by a plate cylinder (second plate cylinder) 20 of the second printing unit 12*b* of the rotary printing press 1.

Since the two first register marks 202 and 204 are printed by the same plate cylinder 20, the distance Dis1 between the respective centroids of the two first register marks 202 and 204 is substantially constant irrespective of misregister.

The two first register marks 202 and 204 and the second register mark 210 are each circular in shape. The area of each of the two first register marks 202 and 204 is substantially half the area of the second register mark 210.

The two first register marks 202 and 204 and the second register mark 210 are arranged along the transporting direction dt of the web 30 in the rotary printing press 1. The second register mark 210 is arranged between the two first register marks 202 and 204.

In the absence of printing misalignment, the first register marks 202 and 204 and the second register mark 210 are arranged such that the centroid of the second register mark 210 coincides with the centroid of the two first register marks 202 and 204. In the presence of printing misalignment, the centroid of the second register mark 210 does not coincide with the centroid of the two first register marks 202 and 204. The centroid of the two first register marks 202 and 204 represents the midpoint between the centroid of one first register mark 202 and the centroid of the other first register mark 204.

Figure 3:
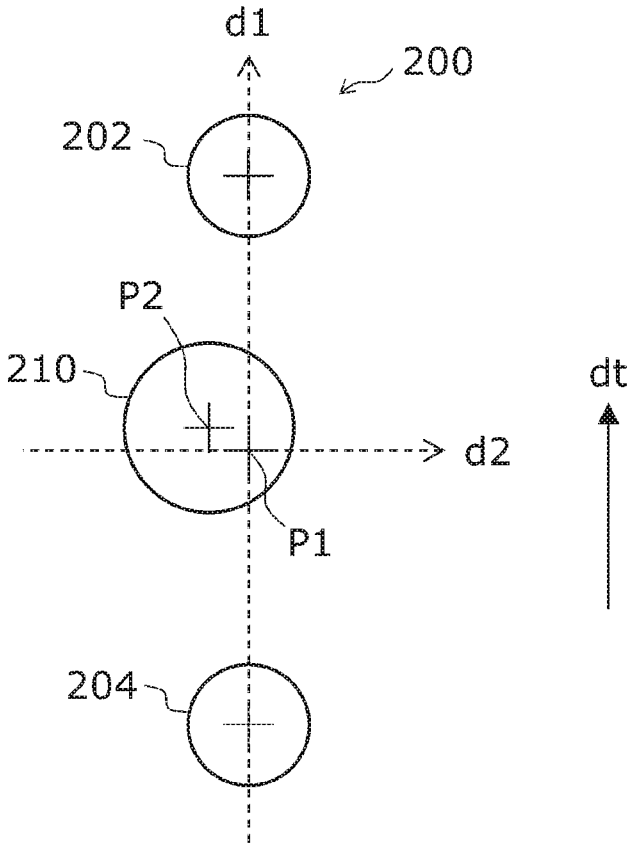
FIG. 3 is a diagram showing an image of the register marks captured by an image capturing unit of FIG. 1.

FIG. 3 is a diagram showing an image of the register mark 200 captured by the image capturing unit 26 of FIG. 1. The calculation unit 28*a* of the register error detection device 100 compares a reference position P1 located between the two first register marks 202 and 204 with a comparison position P2 based on the second register mark 210 in the image of FIG. 3 captured by the image capturing unit 26 and calculates a register error based on the number of pixels between the reference position P1 and the comparison position P2. In the present embodiment, the calculation unit 28*a* uses the centroid of the two first register marks 202 and 204 obtained by known image processing as the reference position P1 and uses the centroid of the second register mark 210 obtained by known image processing as the comparison position P2. During the image processing, the second register mark 210 whose area is different from the areas of the first register marks 202 and 204 can be easily specified.

The method of calculating the reference position P1, which is the centroid of the two first register marks 202 and 204, is not particularly limited. For example, by known image processing, the calculation unit 28*a* may obtain the centroid of the first register mark 202, obtain the centroid of the first register mark 204, and obtain the midpoint of the centroids as the reference position P1. Alternatively, the calculation unit 28*a* can directly calculate the reference position P1 based on the areas of the two first register marks 202 and 204 by known image processing. Since the area of each of the two first register marks 202 and 204 is substantially half the area of the second register mark 210, the sum of the number of samples (i.e., the number of pixels) of the two first register marks 202 and 204 in the image and the number of samples of the second register mark 210 are substantially equal. Therefore, the number of samples used to directly calculate the centroid using the two first register marks 202 and 204 is approximately equal to the number of samples used in calculating the centroid of the second register mark 210. Therefore, in such calculation, an error in the calculation of the centroid can be suppressed.

Based on the number of pixels between the respective centroids of the two first register marks 202 and 204 in the image and the known distance Dis1 between the respective centroids of the two first register marks 202 and 204 that have been printed, the calculation unit 28*a* calculates the distance per pixel. For example, when the known distance Dis1 is 10 mm and the number of pixels is 100 pixels, the distance per pixel is 0.1 mm/pixel. The calculation of the distance per pixel may be performed every time a new image of the first register marks 202 and 204 is captured or may be performed every predetermined period.

The calculation unit 28*a* then calculates the product of the distance per pixel that has been calculated and the number of pixels between the reference position P1 and the comparison position P2 as a register error. More specifically, the calculation unit 28*a* calculates the register error in a direction d1 of a straight line passing through the two first register marks 202 and 204 in the image and a direction d2 orthogonal to this straight line. The direction d1 is equal to the transporting direction dt. The calculation unit 28*a* calculates the product of the distance per pixel and the number of pixels between the reference position P1 and the comparison position P2 in the direction d1 as a longitudinal register error. The calculation unit 28*a* calculates the product of the distance per pixel and the number of pixels between the reference position P1 and the comparison position P2 in the direction d2 as a lateral direction register error.

The control unit 28*b* adjusts the transportation of the web 30 in the transporting direction dt in accordance with the longitudinal register error that has been obtained and adjusts the transportation of the web 30 in the lateral direction in accordance with the lateral register error that has been obtained, so as to correct printing misalignment. The above-mentioned image capturing, calculation of a register error, and correction of printing misalignment are performed every time the second register mark 210 is printed between the two first register marks 202 and 204, and the printing misalignment is corrected in real time during printing.

In the calculation of the registration error, although the number of pixels between the reference position P1 and the comparison position P2 in the image changes in accordance with the distance between the image capturing unit 26 and the register mark 200, since the number of pixels between the centroids of the two first register marks 202 and 204 in the image also changes, the distance per pixel also changes with the same tendency. Therefore, irrespective of the distance between the image capturing unit 26 and the register mark 200, the register error can be calculated with high accuracy.

The user replaces the plate cylinder 20 when printing another kind of printed matter after printing a certain kind of printed matter. However, the new plate cylinder 20 is often different in width and circumferential length from the one before the replacement. In that case, it is necessary to adjust the position of the image capturing unit 26 in accordance with the new plate cylinder 20. However, in the present embodiment, since a register error can be detected with high accuracy regardless of the distance between the image capturing unit 26 and the register mark 200, the adjustment of the position of the image capturing unit 26 is easy. That is, there is no need to accurately adjust the distance between the image capturing unit 26 and the register mark 200 to a certain distance. Therefore, printing of another kind of printed matter can be started in a short time. As a result, it is possible to shorten the printing time of a plurality of kinds of printed matters.

Figure 4:
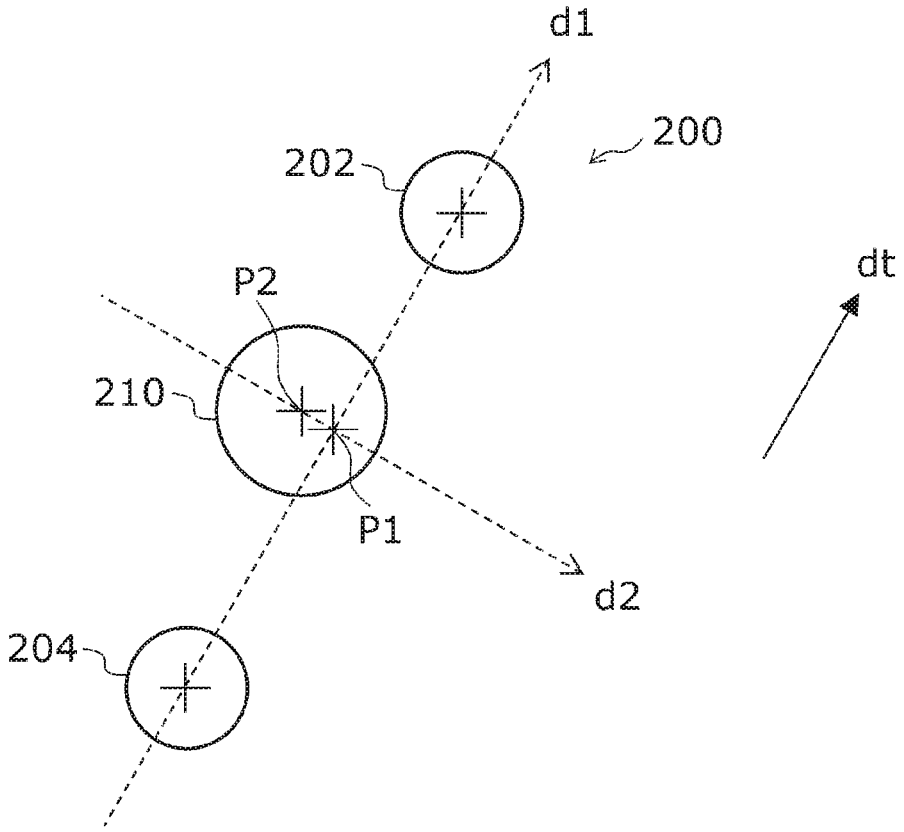
FIG. 4 is a diagram showing an image of the register marks when the image capturing unit of FIG. 1 is rotated in the in-plane direction of the web.

FIG. 4 is a diagram showing an image of the register mark 200 when the image capturing unit 26 of FIG. 1 is rotated in the in-plane direction of the web 30. There is a possibility that the image capturing unit 26 is rotated in the in-plane direction of the web 30 when the user adjusts the position of the image capturing unit 26. In that case, the image that is captured is also rotated as shown in FIG. 4. As described above, the calculation unit 28*a* calculates the register error in the direction d1, that is, the transporting direction dt and in the direction d2. Therefore, even when the image capturing unit 26 is rotated in the in-plane direction of the web 30, the longitudinal register error in the transporting direction dt and the lateral register error in the lateral direction orthogonal to the transporting direction dt can be calculated without being affected by the rotation. Therefore, it is not necessary to adjust the rotation angle of the image capturing unit 26 in the in-plane direction of the web 30 accurately to 0 degrees. Also from this, it is easy to adjust the position of the image capturing unit 26.

Figure 5:
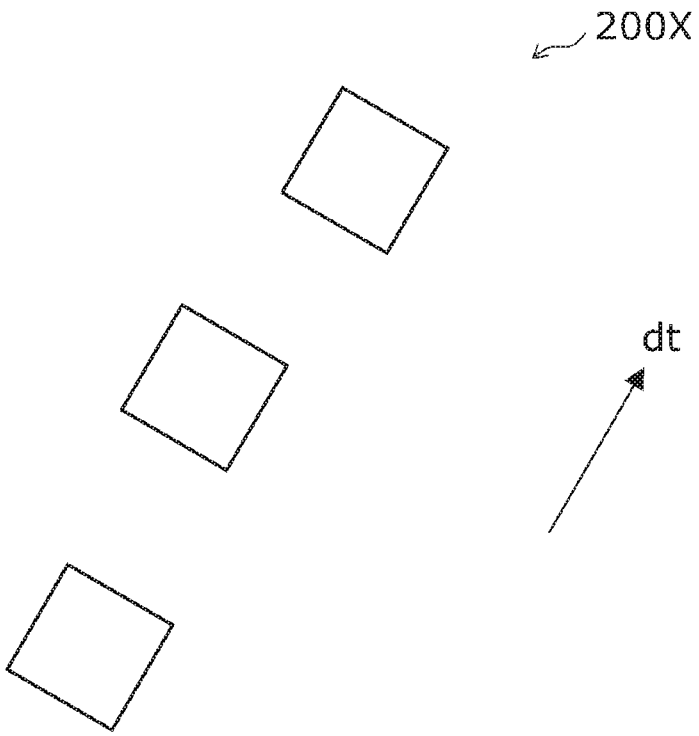
FIG. 5 is a diagram showing an image of other register marks when the image capturing unit of FIG. 1 is rotated in the in-plane direction of the web.

FIG. 5 is a diagram showing an image of another register mark 200X when the image capturing unit 26 of FIG. 1 is rotated in the in-plane direction of the web 30. The shape of each register mark may be a quadrangle as shown in FIG. 5.

However, in the case of a quadrangle, the relationship between the direction of a side of the quadrangle and the direction of the arrangement of the pixels of the image changes according to the rotation of the image capturing unit 26 in the in-plane direction of the web 30, and an error may thus occur at the end portions of each register mark. That is, the number of samples of each register mark in the image may vary between the case where the image capturing unit 26 is rotated in the in-plane direction of the web 30 and the case where the image capturing unit 26 is not rotated in the in-plane direction of the web 30. Therefore, an error may occur in the coordinates of the centroid.

In contrast, in the examples of FIGS. 2 to 4, the first register marks 202 and 204 and the second register mark 210 are each circular in shape. Therefore, the number of samples of each of the first register marks 202 and 204 and the second register mark 210 in the image is hard to vary between the case where the image capturing unit 26 is rotated in the in-plane direction of the web 30 and the case where the image capturing unit 26 is not rotated in the in-plane direction of the web 30. Therefore, an error in the centroid can be suppressed. In other words, the shapes of the first register marks 202 and 204, etc., are preferably circular.

Regarding the two first register marks 202 and 204 printed by the plate cylinder 20 of the second printing unit 12*b* and the second register mark 210 printed by the plate cylinder 20 of the third printing unit 12*c*, a register error can also be calculated in the same way as described above using the image captured by the image capturing unit 26 arranged in the third printing unit 12*c*. Regarding the two first register marks 202 and 204 printed by the plate cylinder 20 of the third printing unit 12*c* and the second register mark 210 printed by the plate cylinder 20 of the fourth printing unit 12*d*, a register error can also be calculated in the same way as described above using the image captured by the image capturing unit 26 arranged in the fourth printing unit 12*d*.

As described above, according to the present embodiment, by using the image obtained by imaging the two first register marks 202 and 204 of the first color and the second register mark 210 of the second color, the product of the distance per pixel and the number of pixels between the reference position P1 and the comparison position P2 of the image is calculated as a register error. Thereby, even when the distance between the image capturing unit 26 and the register mark 200 changes, the register error can be calculated with high accuracy.

Further, since the centroid of the two first register marks 202 and 204 is set as the reference position P1, the reference position P1 can be determined with high accuracy.

Further, since an image of the register mark 200 is captured by an image capturing unit 26, the size of the register mark 200 can be reduced by using a high resolution image capturing unit 26.

Therefore, the size of the register mark 200 can be reduced while suppressing a decrease in the accuracy of detecting register errors.

Further, since the register mark 200 can be made smaller and the two first register marks 202 and 204 and the second register mark 210 are arranged in a line along the transporting direction dt, the width of a region where the register mark 200 is printed can be reduced. After printing, the region of the web 30 in which the register mark 200 is printed is cut out, thus allowing for the saving of loss.

Second Embodiment

The second embodiment is different from the first embodiment in that an additional second register mark is further provided. An explanation will be given in the following mainly regarding differences from the first embodiment.

Figure 6:
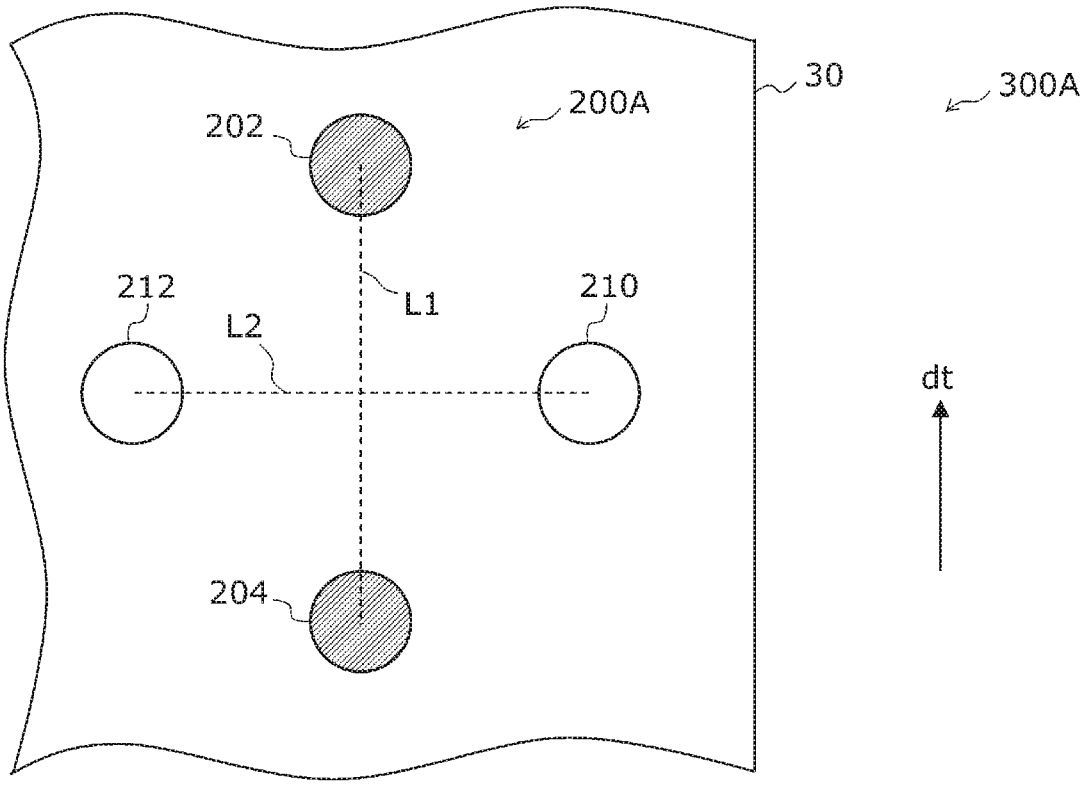
FIG. 6 is a diagram showing a part of a printed matter on which register marks according to a second embodiment are printed.

FIG. 6 is a diagram showing a part of a printed matter 300A on which a register mark 200A according to the second embodiment is printed. As shown in FIG. 6, an additional second register mark 212 of a second color is further printed on a web 30. In the same way as in the second register mark 210, the additional second register mark 212 is printed on the web 30 by a plate cylinder (second plate cylinder) 20 of the second printing unit 12*b* of the rotary printing press 1. The additional second register mark 212 is also circular. The respective areas of the two first register marks 202 and 204, the second register mark 210, and the additional second register mark 212 are substantially equal.

A first line segment L1 connecting the respective centroids of the two first register marks 202 and 204 is orthogonal to a second line segment L2 connecting the centroid of the second register mark 210 and the centroid of the additional second register mark 212. As long as the first line segment L1 and the second line segment L2 intersect with each other, the line segments do not need to be orthogonal to each other.

In the absence of printing misalignment, the first register marks 202 and 204, the second register mark 210, and the additional second register mark 212 are arranged such that the centroid of the second register mark 210 and the additional second register mark 212 coincides with the centroid of the two first register marks 202 and 204. In the presence of printing misalignment, the centroid of the second register mark 210 and the additional second register mark 212 does not coincide with the centroid of the two first register marks 202 and 204. The centroid of the second register mark 210 and the additional second register mark 212 represents the midpoint between the centroid of the second register mark 210 and the centroid of the additional second register mark 212.

The image capturing unit 26 further captures an image of the additional second register mark 212 in addition to the two first register marks 202 and 204 and the second register mark 210.

Figure 7:
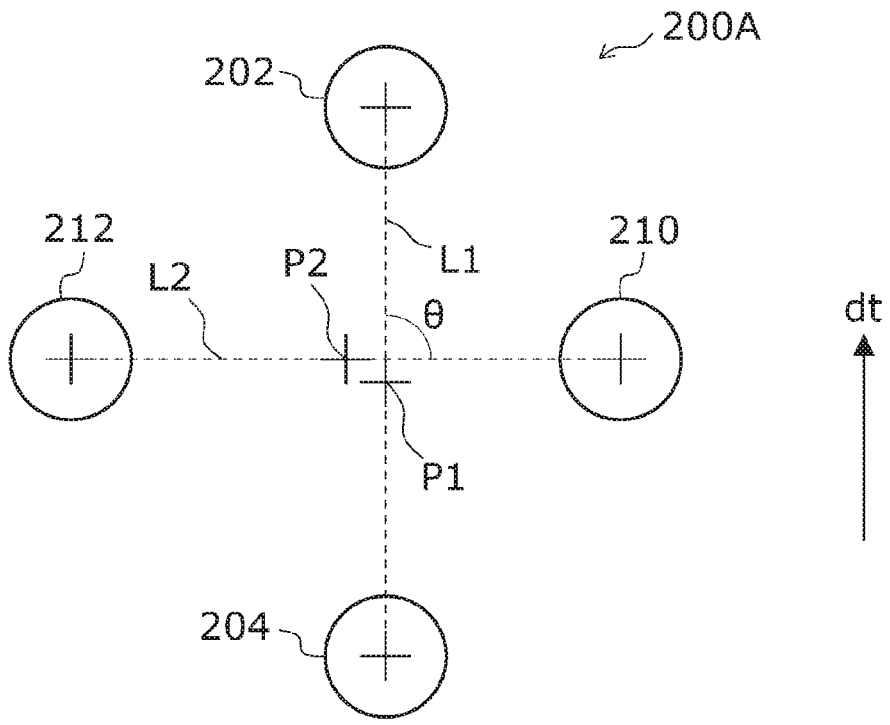
FIG. 7 is a diagram showing an image of the register marks captured by an image capturing unit according to the second embodiment.

FIG. 7 is a diagram showing an image of the register mark 200A captured by the image capturing unit 26 according to the second embodiment. The calculation unit 28*a* uses the centroid of the second register mark 210 and the additional second register mark 212 of the image shown in FIG. 7 as a comparison position P2.

When an angle θ formed by the first line segment L1 and the second line segment L2 is within a predetermined angle range in the image, the calculation unit 28*a* calculates the product of the distance per pixel and the number of pixels between the reference position P1 and the comparison position P2 as a register error, as in the same way as in the first embodiment. Then, the calculation unit 28*a* instructs the control unit 28*b* to control printing misalignment in the rotary printing press 1. The above angle range is, for example, a range from $(90-\alpha)^\circ$ to $(90+\alpha)^\circ$ with a being a constant, and the optimum value can be appropriately determined by an experiment or the like.

Figure 8:
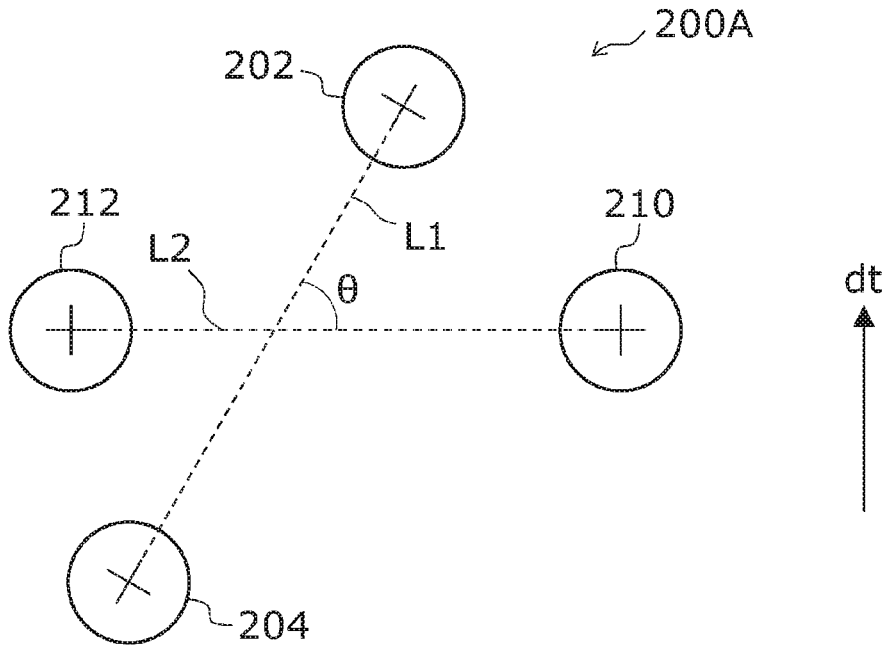
FIG. 8 is a diagram showing another image of the register marks captured by the image capturing unit according to the second embodiment.

FIG. 8 is a diagram showing another image of the register mark 200A captured by the image capturing unit 26 according to the second embodiment. In FIG. 8, the first line segment L1 is inclined with respect to the transporting direction dt. Such a situation may occur, for example, when the web 30 moves in the lateral direction during a period after the printing of the first register mark 202 and before the printing of the first register mark 204.

In the case where the angle θ formed by the first line segment L1 and the second line segment L2 in the image is outside the above angle range, the calculation unit 28*a* performs operation that is different from that in the case where the angle θ is within the above predetermined angle range. For example, when the angle θ is outside the above angle range, the calculation unit 28*a* instructs the control unit 28*b* to prohibit control over printing misalignment in the rotary printing press 1.

As described above, according to the present embodiment, since the control over printing misalignment based on the register mark 200A whose arrangement is different from the normal arrangement is prohibited, it is possible to suppress the control over printing misalignment that may be erroneous. Therefore, the accuracy for the control over printing misalignment can be improved.

Described above is an explanation of the present disclosure based on the embodiments. The embodiments are intended to be illustrative only, and it will be obvious to those skilled in the art that various modifications to constituting elements and processes could be developed and that such modifications are also within the scope of the present disclosure.

For example, in the above embodiment, an example in which the register error detection device 100 is applied to the rotary printing press 1 for gravure printing has been described; however, this is non-limiting. For example, the register error detection device 100 can be applied to a rotary printing press for offset printing. Further, as long as the rotary printing press 1 is a multicolor rotary printing press, the rotary printing press 1 is not limited to four color printing.

In the case where the two first register marks 202 and 204 are printed by the plate cylinder 20 of the first printing unit 12*a* and the second register mark 210 is printed by the plate cylinder 20 of the third printing unit 12*c*, a register error can also be calculated in the same way as described above. In the case where the two first register marks 202 and 204 are printed by the plate cylinder 20 of the first printing unit 12*a* and the second register mark 210 is printed by the plate cylinder 20 of the fourth printing unit 12*d*, a register error can also be calculated in the same way as described above. In this exemplary variation, in each printing unit 12, printing misalignment can be corrected based on a register error calculated using, as a reference, first register marks 202 and 204 printed by the plate cylinder 20 of the same first printing unit 12*a*. Therefore, the accuracy for correcting printing misalignment can be improved. In this exemplary variation, for example, in the case of four color printing, it is necessary to print three sets of two first register marks 202 and 204 in a line by the plate cylinder 20 of the first printing unit 12*a*. Regarding this point, in the above embodiment, since the first register marks 202 and 204 that are small can be used, even a plate cylinder 20 having a relatively short circumferential length can cope with the situation.

Further, when the respective areas of the two first register marks 202 and 204 are different from each other in the image captured, the calculation unit 28*a* may correct a register error based on the areas. When the image capturing unit 26 is inclined in the transporting direction dt with respect to the surface of the web 30, the respective areas of the two first register marks 202 and 204 are different from each other in the image. In this case, since the centroid of the two first register marks 202 and 204 that has been calculated contains an error, the register error is not accurate, either. In this exemplary variation, a more accurate registration error can be obtained in consideration of the influence of the inclination of the image capturing unit 26.

What is claimed is:

1. A register error detection device comprising:

an image capturing unit that captures an image of two first register marks of a first color printed on a substrate by a first plate cylinder of a rotary printing press and a second register mark of a second color printed on the substrate by a second plate cylinder of the rotary printing press; and a calculation unit that compares a reference position located between the two first register marks with a comparison position that is based on the second register mark in the image captured by the image capturing unit, wherein the calculation unit calculates a register error based on the number of pixels between the reference position and the comparison position, and wherein the calculation unit calculates the distance per pixel based on the number of pixels between the respective centroids of the two first register marks in the image and a known distance between the respective centroids of the two first register marks that have been printed, and calculates the product of the distance per pixel and the number of pixels between the reference position and the comparison position as the register error.

2. The register error detection device according to claim 1, wherein the two first register marks and the second register mark are arranged along the transporting direction of the substrate in the rotary printing press, wherein the second register mark is arranged between the two first register marks, and wherein the calculation unit uses the centroid of the second register mark as the comparison position.

3. The register error detection device according to claim 2, wherein the calculation unit calculates the register error in the direction of a straight line passing through the two first register marks in the image and a direction orthogonal to the straight line.

4. The register error detection device according to claim 1, wherein the area of each of the two first register marks is substantially half the area of the second register mark.

5. The register error detection device according to claim 1, wherein the two first register marks and the second register mark are each circular in shape.

6. The register error detection device according to claim 1, wherein the image capturing unit further captures an image of an additional second register mark of the second color printed on the substrate by the second plate cylinder, wherein a first line segment connecting the two first register marks intersects with a second line segment connecting the second register mark and the additional second register mark, and wherein the calculation unit uses the centroid of the second register mark and the additional second register mark as the comparison position.

7. The register error detection device according to claim 6, wherein the calculation unit prohibits control over printing misalignment in the rotary printing press when an angle formed by the first line segment and the second line segment in the image is outside a predetermined angle range.

8. A register error detection method comprising:

capturing an image of two first register marks of a first color printed on a substrate by a first plate cylinder of a rotary printing press and a second register mark of a second color printed on the substrate by a second plate cylinder of the rotary printing press; and comparing a reference position located between the two first register marks with a comparison position that is based on the second register mark in the image that has been captured, wherein in the comparing, calculating a register error based on the number of pixels between the reference position and the comparison position, and wherein in the comparing, calculating the distance per pixel based on the number of pixels between the respective centroids of the two first register marks in the image and a known distance between the respective centroids of the two first register marks that have been printed, and calculating the product of the distance per pixel and the number of pixels between the reference position and the comparison position as the register error.

9. A register error detection device comprising:

an image capturing unit that captures an image of two first register marks of a first color printed on a substrate by a first plate cylinder of a rotary printing press and a second register mark of a second color printed on the substrate by a second plate cylinder of the rotary printing press; and a calculation unit that compares a reference position located between the two first register marks with a comparison position that is based on the second register mark in the image captured by the image capturing unit, wherein the image capturing unit further captures an image of an additional second register mark of the second color printed on the substrate by the second plate cylinder, wherein a first line segment connecting the two first register marks intersects with a second line segment connecting the second register mark and the additional second register mark, wherein the calculation unit uses the centroid of the second register mark and the additional second register mark as the comparison position, and wherein the calculation unit prohibits control over printing misalignment in the rotary printing press when an angle formed by the first line segment and the second line segment in the image is outside a predetermined angle range.

10. The register error detection device according to claim 9, wherein the calculation unit calculates a register error based on the number of pixels between the reference position and the comparison position.

* * * * *